US008062058B1

(12) United States Patent
Moldoch et al.

(10) Patent No.: US 8,062,058 B1
(45) Date of Patent: Nov. 22, 2011

(54) INSULATION DISPLACEMENT CONNECTOR SYSTEM AND APPARATUS

(75) Inventors: Michael J. Moldoch, Griswold, CT (US); Adam Murano, Lebanon, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 12/840,610

(22) Filed: Jul. 21, 2010

(51) Int. Cl.
*H01R 4/24* (2006.01)

(52) U.S. Cl. ..... 439/404

(58) Field of Classification Search ..... 439/404, 439/941, 676, 405, 402, 417, 885, 395
See application file for complete search history.

(56) References Cited

U.S. PATENT DOCUMENTS 4,869,684 A * 9/1989 Cloud et al. ..... 439/402
6,799,989 B2 * 10/2004 Doorhy et al. ..... 439/404
7,175,476 B2 * 2/2007 Kim et al. ..... 439/620.11
2004/0092153 A1 * 5/2004 Peng ..... 439/404
2005/0170682 A1 * 8/2005 Kim et al. ..... 439/417

* cited by examiner

*Primary Examiner* — Edwin A. Leon

(74) *Attorney, Agent, or Firm* — McCarter & English, LLP

(57) ABSTRACT

An electrical connector has a plurality of insulation displacement connectors (IDCs) grouped together by an injection-molded, plastic bridge. The bridge integrates the IDCs permitting easier handling and assembly with other electrical elements, such as by inserting projections from the IDCs into vias of a printed circuit board. The bridge results in a strengthened IDC group structure and facilitates interaction with an assembly tool, thereby allowing smaller IDCs and diminishing cross-talk. The IDC group may be utilized with a mating IDC cover having resilient members which resiliently supports and shields the IDCs and an attached circuit. The IDC groups may be utilized in fabricating a connector, such as a CAT 6 connector.

23 Claims, 5 Drawing Sheets

INSULATION DISPLACEMENT CONNECTOR SYSTEM AND APPARATUS

TECHNICAL FIELD

The present disclosure is directed to insulation displacement connectors (IDCs) for connecting to and/or terminating wires and cables and methods for making same. The present disclosure is further directed to structures and methods for assembling IDCs to other electrical devices, such as circuits, and to structures and methods for shielding and insulating IDCs from unwanted contact. The present invention is further directed to structures and methods for making connectors having IDCs.

BACKGROUND ART

IDCs are known and widely used for connecting to and/or terminating wires and cables, e.g., at male and female connectors. Despite their widespread use, it remains an objective to reduce crosstalk at the IDC/wire interface, e.g., at terminals utilizing IDCs. It is a further objective to provide electrical devices that utilize IDCs with a more rigid and regular IDC geometry, as well as facilitating the economical manufacture of IDCs and the electrical apparatus which utilize them. It is a further objective to provide effective insulation shielding for IDC contacts, such that wires and cables can be reliably terminated and used with the IDCs. These demands grow ever more rigorous as data speed and volume through connectors increases, while the overall dimensions of connectors remain constrained by a preference for small form factor and by considerations of backward compatibility.

SUMMARY

The present disclosure is directed to an electrical connector having an insulation displacement connector (IDC) for electrically intermediating between a conductor wire and an electrical element. The IDC has a conductor portion conductive to electricity and with a pair of spaced arms between which the wire may be received. The IDC also has a contact portion in electrical continuity with the conductor portion, the contact portion adapted to be connected to the electrical element, and an insulator portion. The insulator portion is formed from a material that is electrically non-conductive and is attached to the conductor portion intermediate the pair of spaced arms and the contact portion. The insulator portion extends from the conductor portion in a generally perpendicular direction.

In accordance with a method for making the connector, an IDC is positioned relative to a mold cavity and insulator material is injected into the mold to form the insulator portion.

Additional features, functions and benefits of the disclosed connector and techniques for making and using it will be apparent from the detailed description which follows, particularly when read in conjunction with the appended figures.

BRIEF DESCRIPTION OF FIGURES

To assist those of skill in the art in making and using the disclosed IDC systems and connectors, reference is made to the accompanying figures.

DESCRIPTION OF EXEMPLARY EMBODIMENT(S)

Figure 1:
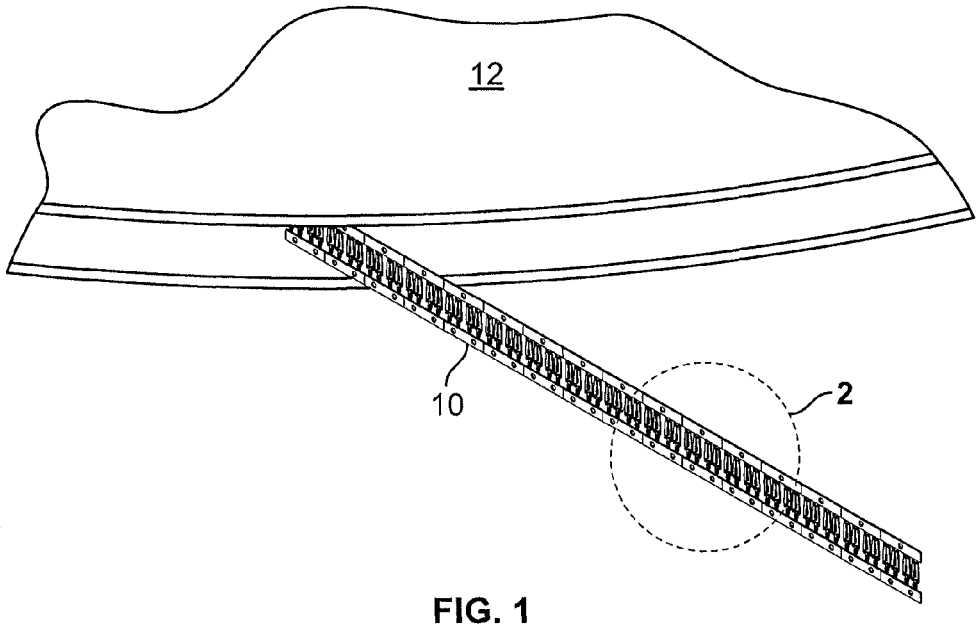
FIG. 1 is a perspective view of a ribbon of IDC terminals dispensed from a spool in accordance with the present disclosure.

FIG. 1 shows a ribbon 10 of stamped IDC connectors dispensed from a spool 12 (only a portion of which is shown).

Figure 2:
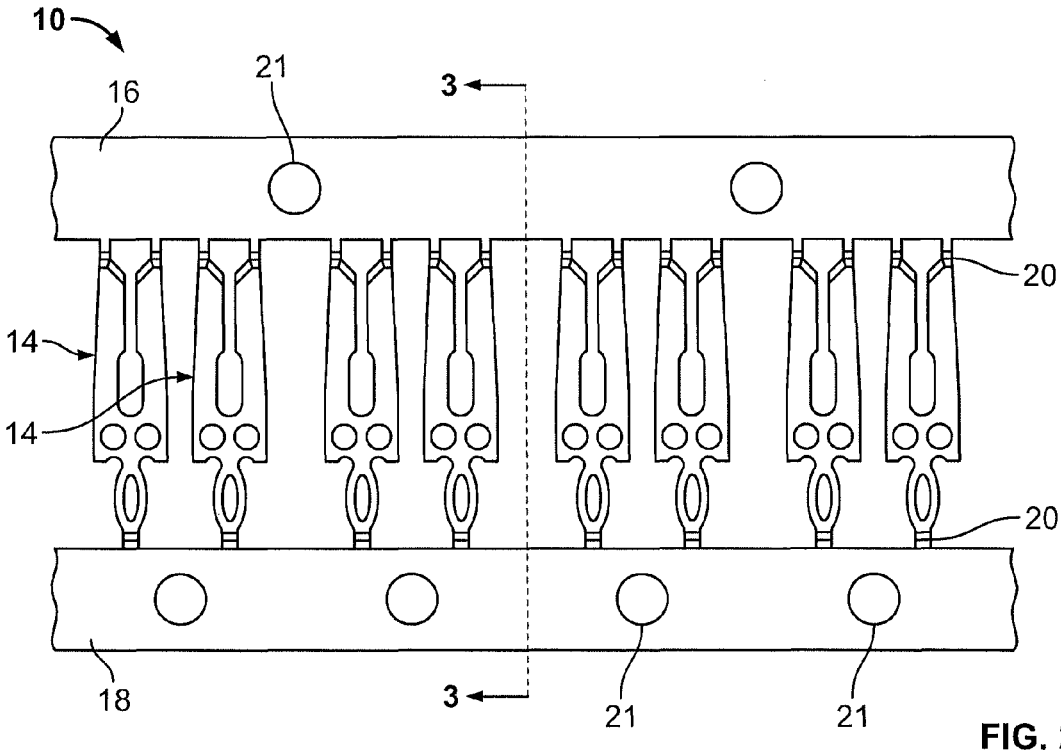
FIG. 2 is an enlarged plan view of a segment of the ribbon of IDC terminals shown in FIG. 1.
Figure 3:
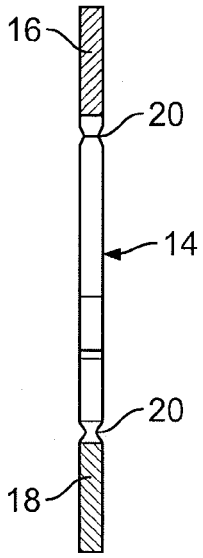
FIG. 3 is a side view of an IDC in the ribbon of IDC terminals shown in FIG. 2 looking along section line in the direction of the arrows.

FIGS. 2 and 3 show that the ribbon 10 includes a plurality of IDC connectors 14 attached to top and bottom feeder rails 16, 18, respectively. The IDCs 14 are connected to the feeder rails at coined interfaces, 20 viz., areas that are struck down to a thin cross-section and that can be easily broken manually or automatically to separate the IDCs 14 from the feeder rails 16, 18. The feeder rails 16, 18 feature positioning indicia 21, such as applied paint or ink marks or punched apertures for establishing the exact position of the IDCs 14 of the ribbon 10 relative to an injection molding apparatus, as further described below. The positioning indicia 21 can be sensed by an optical sensor to control a ribbon advance mechanism or, in the case of positioning apertures, the apertures can be utilized to engage with cogs of an advance wheel for controlling the position of the IDCs 14 of the ribbon 10.

Figure 4:
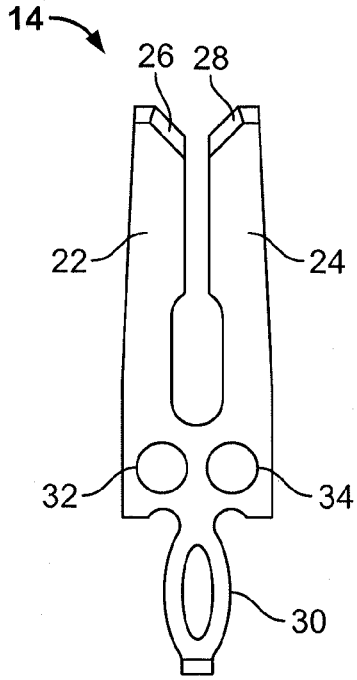
FIG. 4 is an enlarged plan view of a single IDC terminal shown in FIGS. 2 and 3, separated from the ribbon of conjoined terminals.

FIG. 4 shows an individual IDC 14 having a pair of tines 22, 24, each having a corresponding cutting edge 26, 28, respectively, proximate a top end thereof. The IDC 14 is made from a conductor material, such as beryllium copper having a thickness and elasticity permitting flexing of the tines 22, 24 to grip a wire (not shown) that is pushed between them. As is conventional, the cutting edges 26, 28, cut into the insulation of a wire such that a conductor at the center of the wire can electrically contact the tines 22, 24 when pushed between them. A mounting projection 30 at the bottom of the IDC 14 permits the IDC 14 to be mounted to a circuit board by insertion into a via 46 (See FIG. 9), as described further below. One or more apertures 32, 34 may be provided in the IDC 14 to allow in-flow of injection molding plastic to promote the structural integration of the plastic and the IDC 14, as described further below.

Figure 5:
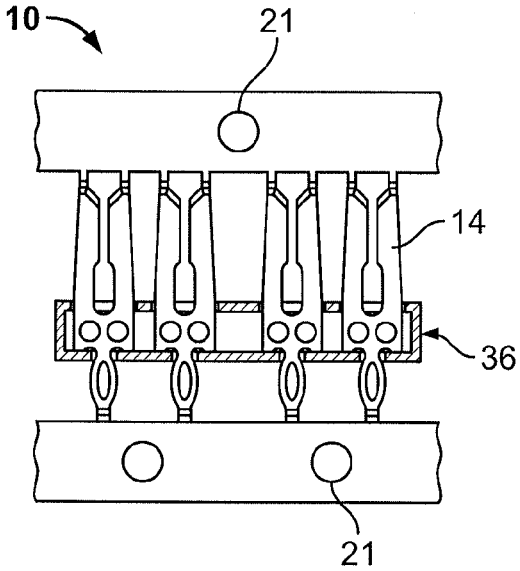
FIG. 5 is an enlarged plan view of a segment of a ribbon of IDC terminals like that shown in FIG. 2, but shorter in length and positioned relative to a portion of an injection mold.

FIG. 5 shows a segment of ribbon 10 with four IDCs 14 positioned over a portion of an injection molding mold (die) 36. A mating mold (not shown) would be positioned over the mold portion 36 and the four IDCs shown would be partially encapsulated by injection-molding plastic injected into the cavity formed by the mating mold portions in accordance with known injection molding techniques.

Figure 6:
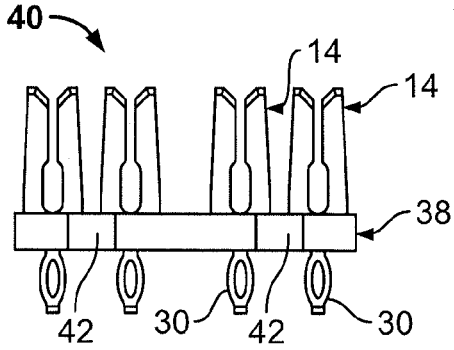
FIG. 6 is a plan view of a group of IDC terminals conjoined by a bridge member.
Figure 7:
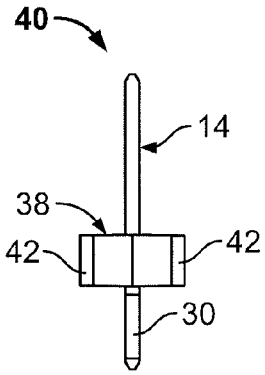
FIG. 7 is a side view of the conjoined group of IDC terminals of FIG. 6.
Figure 8:
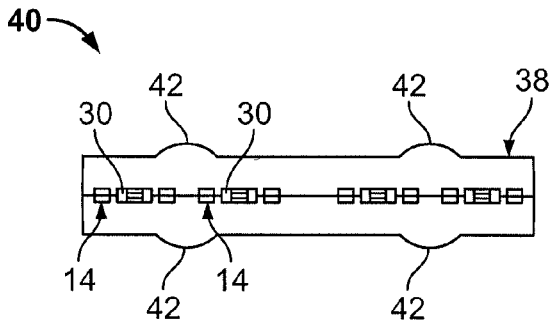
FIG. 8 is a bottom view of the conjoined group of IDC terminals of FIGS. 6 and 7.

FIGS. 6-8 show a group of four IDCs 14 conjoined by a plastic, injection-molded bridge 38 to form an IDC group 40. The bridge 38 features a plurality of bulges 42 defining a tool engagement area against which a pushing tool may be applied when pushing the mounting projections 30 of IDC group 40 into corresponding vias 46 of a circuit board. The IDC group 40 conjoined by bridge 38 has beneficial attributes, in that it is larger and easier to handle (either by a human hand or by a robot) than individual IDCs 14. Because the IDCs 14 are structurally unified, they may be installed on to a given circuit board as a group substantially simultaneously, thereby speeding and simplifying assembly over individual IDC assembly. Since the IDCs of a group 40 are firmly structurally connected together and oriented by the bridge 38, the orientation and structural integrity of the IDC group 40 is increased over a like number of independent, individual IDCs mounted on a given electrical mounting, e.g., in the vias of a circuit board. In the past, IDCs were sometimes provided with pushing tabs or shoulders that allowed tools to engage and press the IDC into a circuit via. The width of the IDC was enlarged by the extent of the pushing tabs, thereby necessitating greater spacing between the IDCs to avoid cross-talk between adjacent IDCs. Because the bridge 38, especially the bulges 42, provide a pressing surface against which a tool may act, the IDCs may be placed closer together, since the IDCs do not need features that may be engaged by a placement tool that grasps and pushes individual IDCs during assembly of the IDC to an electrical component.

While four IDCs are included in IDC group 40, any number could be used, from a single IDC 14, to a multitude. While the IDCs 14 of IDC group 40 depicted are each aligned in side-by-side orientation and conjoined by a generally, linear bridge 38, the IDCs could be disposed at any relative orientation and held in that orientation by a suitably shaped bridge 38. For example, the bridge 38 could be rectangular and support a constellation of IDCs disposed proximate the edges thereof.

Figure 9:
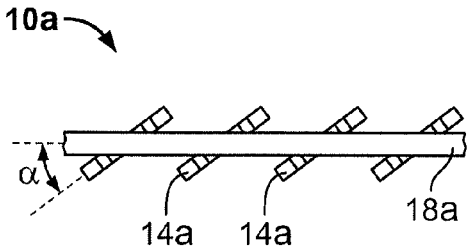
FIG. 9 is a bottom view of the ribbon of FIG. 2 after an optional stamping step which displaces the IDCs at an angle.

FIG. 9 shows a ribbon 10*a* like ribbon 10 shown in FIG. 5, viewed from the bottom. The ribbon 10*a* has been subjected to a die stamping process wherein the IDCs 14*a* are twisted at an angle $\alpha$ relative to the rails 16*a*, 18*a* (only bottom rail 18*a* is visible in this view). The ribbon 10*a* may then be positioned relative to a mold like mold 36 shown in FIG. 5, but which accommodates the angularly displaced IDCs 14*a*. The twisting of the IDCs 14*a* may be conducted on a flat ribbon 10 as a subsequent step or be conducted by the stamping machine that fabricates the ribbon 10 from metal stock.

Figure 10:
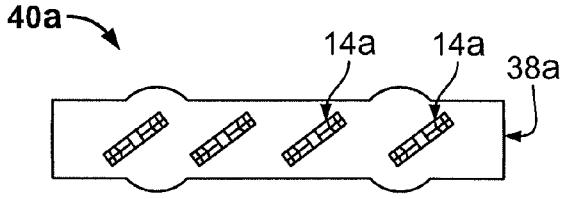
FIG. 10 is a top view of an IDC group like that of FIG. 6, but formed from IDCs displaced at an angle as shown in FIG. 9.

FIG. 10 is a top view of an IDC group 40*a* having angled IDCs 14*a*, like those shown in FIG. 9.

Figure 11:
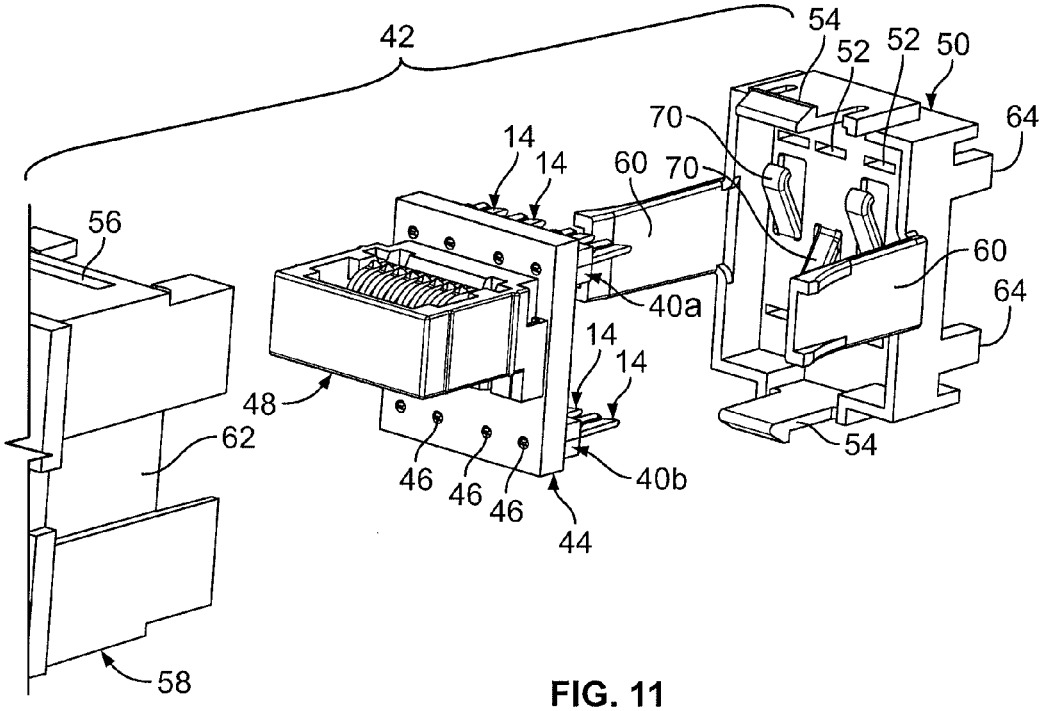
FIG. 11 is an exploded perspective view of a terminal assembly in accordance with the present disclosure.
Figure 12:
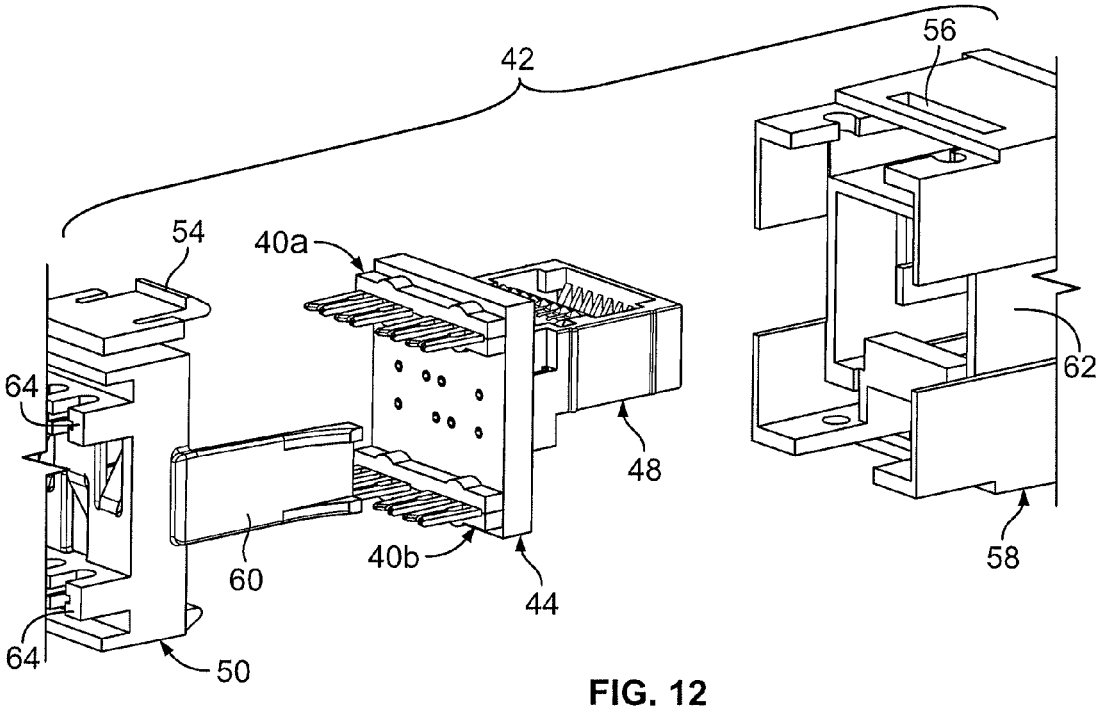
FIG. 12 is an exploded perspective view of the assembly of FIG. 9 seen from another direction.
Figure 13:
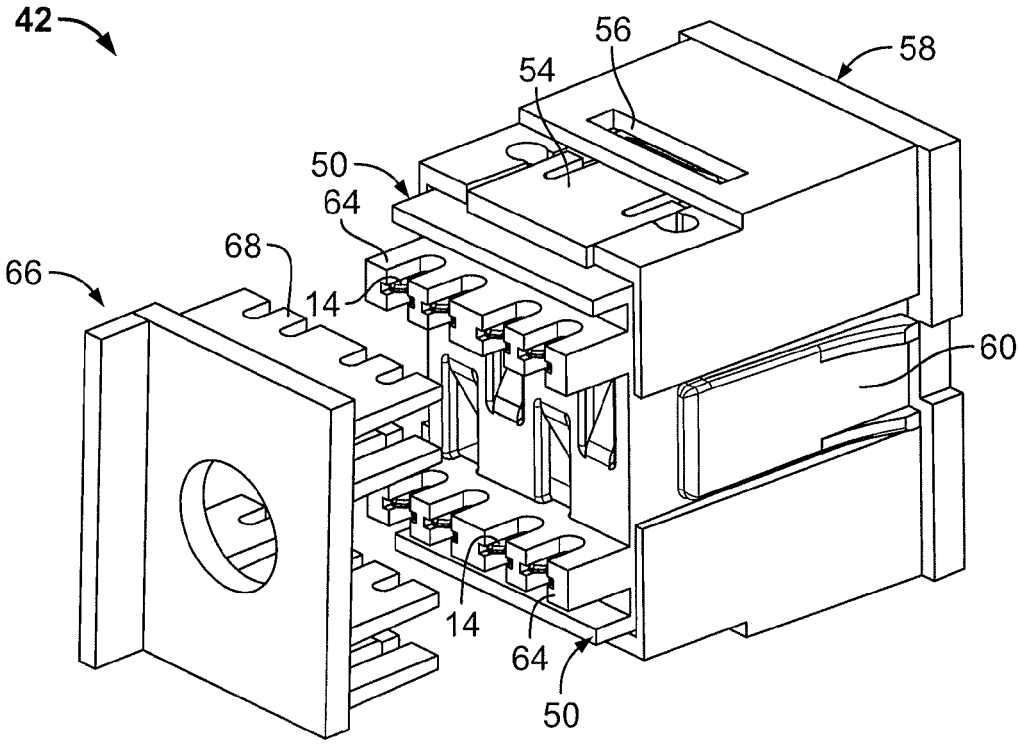
FIG. 13 is a perspective view of the assembly of FIGS. 9 and 10 and including a wire retainer juxtaposed near the IDC terminals of the assembly.

FIGS. 11, 12 and 13 show a connector 42 utilizing IDC groups 40A and 40B attached to a circuit board 44 by insertion of the mounting projections 30 of each IDC 14 into a corresponding via 46 in the circuit board 44. The circuit board 44 may also receive other electrical elements 48 mounted and/or electrically attached thereto, such as a plug or a socket (couplable connector) of a connector 42. For example, the connector 42 may be a CAT 5, CAT 6 or Cat 6a connector/terminal. The IDC group 40 disclosed herein is not limited in use for forming connectors, however, and may be used to intermediate between any electrical device/circuit 44 and wires attached to the IDC group(s) 40.

An electrically insulating IDC cover 50 made from, e.g., glass-filled polycarbonate, has a plurality of IDC apertures 52 into which the IDCs 14 projecting from the IDC groups 40 mounted on the circuit board 44 may be received. The IDC cover 50 may be provided with one or more clip arms 54 for engaging mating apertures 56 in a housing 58 to retain the IDC cover 50 and housing 58 together. As shown in FIGS. 9-11, the IDC cover 50 may capture the circuit board 44 with mounted IDC groups 40 and element 48 between the IDC cover 50 and the housing 58 when the cover 50 is attached to the housing 58. One or more retainer arms 60 may project from the IDC cover 50 and be received in grooves 62 in the housing to retain the connector 42 in an aperture in a panel (not shown). The IDC cover 50 has a plurality of IDC shields 64 disposed about the IDC apertures 52 to support and shield the IDCs 14 from inadvertent mechanical and electrical contact. A wire retainer 66 (See FIG. 13) has wire pushing features 68 that align with the IDCs 14 and IDC shields 64 and which urge wires into electrical and mechanical contact with the IDCs 14.

Referring again to FIGS. 11 and 12, the IDC cover 50 may feature one or more spring fingers 70 which engage the circuit board 44 and resiliently urge the circuit board 44 and IDC cover 50 away from each other. By implication, the spring fingers 70 also urge the circuit board 44 and any attached elements, such as element 48, into the housing 58 when the cover 50 is attached to the housing 58 by the engagement of the clip arms 54 with the apertures 56. The spring fingers 70 therefore resiliently hold the circuit board 44 in position within the housing and hold the connected IDCs at a predetermined protected position within the ICD shields 64. The foregoing relationships are established resiliently rather than rigidly, such that movement is possible in response to mechanical forces, e.g., when a mating connector is manually engaged with element 48, e.g., a plug/socket or when wires are pushed into contact with the IDCs by wire retainer 66 or a wire punch tool. The interior surface of the IDC cover 50 proximate the IDC apertures 52 may be dimensioned to press against the top surface of the bridge(s) 38 of IDC group(s) 40A, 40B when the cover is retained on the housing 58 by the clip arms 54, thereby pressing the IDC group 40 towards the circuit board 44 and/or retaining the mounting projections 30 within the vias 46 by limiting the range of motion of the IDC group(s) 40.

Figure 14:
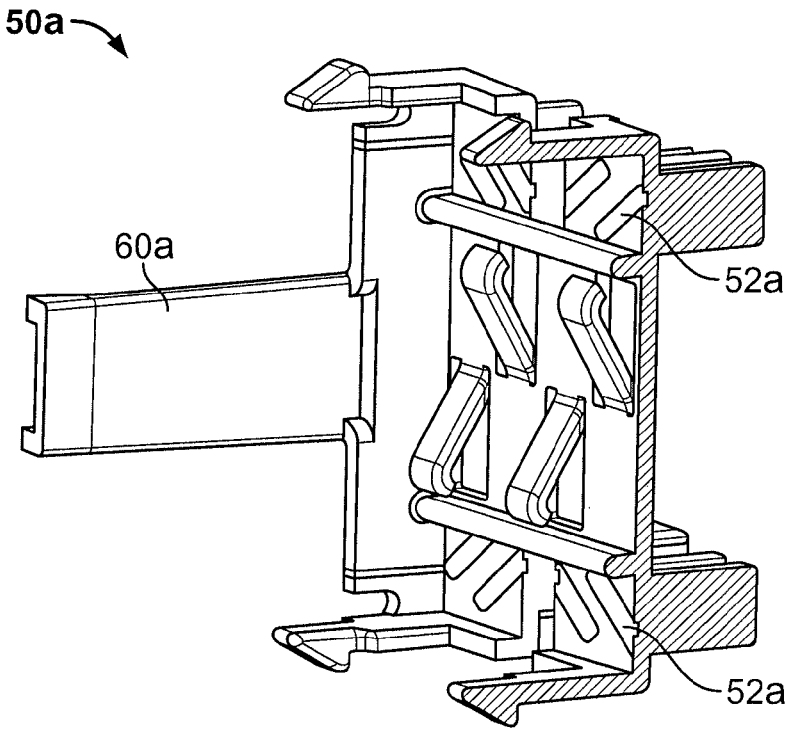
FIG. 14 is a perspective view of an IDC cover in accordance with another aspect of the present disclosure.

FIG. 14 shows an IDC cover 50*a* (with one retainer arm 60*a* structure removed) wherein the apertures 52*a* are angled to receive angled IDCs 14*a* like those shown in FIG. 10. The angled orientation of the IDCs 14*a* can facilitate the process of pushing wires into the IDCs 14*a*, in that a wire pushed into an IDC 14*a* at an angle relative thereto has the insulation cut at an offset position (on either side of the wire) allowing the wire to bend between the offset and relieving stress that would otherwise be present.

Although the present disclosure has been described with reference to exemplary embodiments and implementations, it is to be understood that the present disclosure is neither limited by nor restricted to such exemplary embodiments and/or implementations. Rather, the present disclosure is susceptible to various modifications, enhancements and variations without departing from the spirit or scope of the present disclosure. The present disclosure expressly encompasses such modifications, enhancements and variations as will be readily apparent to persons skilled in the art from the present disclosure.

What is claimed is:

1. An electrical connector, comprising:

an insulation displacement connector (IDC) for electrically intermediating between a conductor wire and an electrical element, said IDC having a conductor portion, said conductor portion being conductive to electricity and having a pair of spaced arms between which the wire may be received and a contact portion in electrical continuity with the conductor portion, said contact portion adapted to be connected to the electrical element, and an insulator portion, said insulator portion being formed from a material that is electrically non-conductive and being attached to said conductor portion intermediate said pair of spaced arms and said contact portion, said insulator portion extending from said conductor portion in a generally perpendicular direction;

wherein the conductor portion includes at least one aperture therethrough, the at least one aperture positioned intermediate said pair of spaced arms and said contact portion, said at least one aperture housing at least a portion of said insulator portion material; and wherein at least a portion of said insulator portion material housed in said at least one aperture extends through said at least one aperture.

2. The electrical connector of claim 1, further comprising a plurality of IDCs, said insulator portion extending between and attaching to each of said plurality of IDCs to a form a bridge therebetween and to define an IDC group.

3. The electrical connector of claim 2, wherein at least one of said IDCs of said plurality has a projection from said contact portion adapted to be received in a via, said bridge having a tool engagement area adapted to engage a pushing tool for pushing said projection into a via.

4. The electrical connector of claim 3, wherein said bridge is formed from injection molded plastic and said conductor portion of each IDC in said IDC group has an aperture therein allowing the injection molded plastic to flow through said aperture thereby strengthening the structural attachment of said conductor portion and said bridge.

5. The electrical connector of claim 3, wherein said electrical element is a circuit having a plurality of said vias and said plurality of IDCs have projections receivable in said plurality of vias.

6. The electrical connector of claim 5, further comprising a housing, said housing having an IDC cover portion and an opposing portion, said IDC cover portion having a plurality of apertures therein for receiving said plurality of IDCs, said cover portion being formed from an insulator material and at least partially shielding said IDCs from inadvertent contact, while preserving access of a wire to the IDCs for electrically connecting thereto.

7. The electrical connector of claim 6, wherein said housing receives said circuit in an internal hollow thereof and said IDC cover is adapted to attach to said opposing portion to capture said circuit within said housing, said IDC cover having a spring arm extending from an internal surface thereof for urging said circuit into said housing and away from said IDC cover.

8. The electrical connector of claim 7, further comprising a second electrical element electrically connected to said circuit and extending from said circuit opposite to said IDCs.

9. The electrical connector of claim 8, wherein said second electrical element is a couplable connector, said couplable connector adapted to removably electrically couple to a mating couplable connector, said second electrical element extending through an aperture in said housing to allow coupling to said mating couplable connector.

10. The electrical connector of claim 9, wherein said couplable connector is at least one of a CAT 5, CAT 6 and CAT 6a connector.

11. The electrical connector of claim 10, wherein the couplable connector is a socket which receives a plug.

12. The electrical connector of claim 11, wherein said couplable connector has dual compatibility with more than one plug pin configuration.

13. The electrical connector of claim 6, wherein an internal surface of said IDC cover limits the range of motion of said IDC group by abutting against said bridge, preventing disconnection from said circuit when said cover is attached to said housing.

14. The electrical connector of claim 6, wherein at least one of said plurality of IDCs is an angled IDC disposed at an angle relative to said bridge and wherein at least one of said plurality of apertures in said IDC cover portion is oriented to matingly receive said angled IDC.

15. The electrical connector of claim 3, wherein a length dimension of said bridge extends in a direction between said plurality of IDCs and said IDCs have a width dimension extending in a direction between said pair of spaced arms, at least one of said plurality of IDCs has said width dimension disposed at an angle relative to said length dimension of said bridge.

16. An electrical connector comprising:

a first electrical element having a plurality of vias;

a plurality of insulation displacement connectors (IDCs), each IDC for electrically intermediating between a conductor wire and the first electrical element, each IDC having: (i) a conductor portion, said conductor portion being conductive to electricity and having a pair of spaced arms between which a wire may be received, (ii) a contact portion in electrical continuity with the conductor portion, said contact portion adapted to be connected to the electrical element, and (iii) a projection from said contact portion receivable in one of said plurality of vias;

an insulator portion extending between and attaching to each of said plurality of IDCs to form a bridge therebetween and to define an IDC group;

a housing, said housing having an IDC cover portion and an opposing portion, said IDC cover portion having a plurality of apertures therein for receiving said plurality of IDCs, said cover portion being formed from an insulator material and at least partially shielding said IDCs from inadvertent contact, while preserving access of a wire to the IDCs for electrically connecting thereto.

17. The electrical connector of claim 16, wherein said housing receives said first electrical element in an internal hollow thereof and said IDC cover is adapted to attach to said opposing portion to capture said first electrical element within said housing, said IDC cover having a spring arm extending from an internal surface thereof for urging said first electrical element into said housing and away from said IDC cover.

18. The electrical connector of claim 17, further comprising a second electrical element electrically connected to said first electrical element and extending from said first electrical element opposite to said IDCs.

19. The electrical connector of claim 18, wherein said second electrical element is a couplable connector, said couplable connector adapted to removably electrically couple to a mating couplable connector, said second electrical element extending through an aperture in said housing to allow coupling to said mating couplable connector.

20. The electrical connector of claim 19, wherein said couplable connector is at least one of a CAT 5, CAT 6 and CAT 6a connector.

21. The electrical connector of claim 19, wherein the couplable connector is a socket which receives a plug; and wherein said couplable connector has dual compatibility with more than one plug pin configuration.

22. The electrical connector of claim 16, wherein an internal surface of said IDC cover limits the range of motion of said IDC group by abutting against said bridge, preventing disconnection from said first electrical element when said cover is attached to said housing.

23. The electrical connector of claim 16, wherein at least one of said plurality of IDCs is an angled IDC disposed at an angle relative to said bridge and wherein at least one of said plurality of apertures in said IDC cover portion is oriented to matingly receive said angled IDC.

* * * * *